US011634898B2

(12) United States Patent
Schluetter et al.

(10) Patent No.: US 11,634,898 B2
(45) Date of Patent: Apr. 25, 2023

(54) SINK WITH ACCESSORY RAILS

(71) Applicant: Zentrum LLC, Delray Beach, FL (US)

(72) Inventors: Michael Schluetter, West Palm Beach, FL (US); Marlon Carias, Palm Beach Gardens, FL (US)

(73) Assignee: Zentrum LLC, Delray Beach, FL (US)

( * ) Notice: Subject to any disclaimer, the term of this patent is extended or adjusted under 35 U.S.C. 154(b) by 0 days.

(21) Appl. No.: 17/212,147

(22) Filed: Mar. 25, 2021

(65) Prior Publication Data

US 2022/0307248 A1 Sep. 29, 2022

(51) Int. Cl.
*E03C 1/182* (2006.01)

(52) U.S. Cl.
CPC ..... *E03C 1/182* (2013.01)

(58) Field of Classification Search
CPC ..... E03C 1/14; E03C 1/18; E03C 1/182
USPC ..... 4/650, 619
See application file for complete search history.

(56) References Cited

U.S. PATENT DOCUMENTS 1,741,606 A * 12/1929 Bean ..... E03C 1/18 4/642
2,672,255 A * 3/1954 Mustee ..... D06F 39/12 312/228
4,305,165 A * 12/1981 Wall, Jr. ..... A47K 3/06 4/549
2004/0181870 A1* 9/2004 Bohacik ..... B21D 51/18 4/619
2010/0251477 A1* 10/2010 Bates ..... E03C 1/24 4/680
2012/0222211 A1* 9/2012 Booth ..... E03C 1/18 4/619
2013/0283521 A1* 10/2013 Jain ..... E03C 1/186 4/654
2018/0187400 A1* 7/2018 Chong ..... E03C 1/182
2020/0263401 A1* 8/2020 Levi ..... E03C 1/18
2021/0254318 A1* 8/2021 Davis ..... E03C 1/33

OTHER PUBLICATIONS

Diamond Brite (https://www.diamondbritemetals.com/post/non-directional-mirror-finish-what-is-it-and-where-is-it-used); Feb. 5, 2020 (Year: 2020).*

* cited by examiner

*Primary Examiner* — Benjamin R Shaw
(74) *Attorney, Agent, or Firm* — Carlson, Gaskey & Olds, P.C.

(57) ABSTRACT

A sink includes a base that has a drain. A front wall extends upward from the base. A rear wall extends upward from the base. A first side wall and a second side wall extend upward from the base. The first side wall includes a first height from the base being greater than a second height of the second side wall from the base by approximately 1 cm (0.39 inches).

20 Claims, 6 Drawing Sheets

SINK WITH ACCESSORY RAILS

BACKGROUND

The present disclosure relates to a sink, and more particularly, to a kitchen sink.

A kitchen sink is a central component in a kitchen and experiences frequent use and requires regular cleaning. The kitchen sink is generally recessed into a sink base cabinet that houses the plumbing associated with water management for the kitchen sink. The kitchen sink can be mounted underneath a countertop and be at least partially supported by the sink base cabinet. The countertop to includes a sink opening for accessing the kitchen sink and allowing kitchen debris on the adjacent countertop to be wiped into the sink for disposal.

SUMMARY

In one exemplary embodiment, a sink includes a base that has a drain. A front wall extends upward from the base. A rear wall extends upward from the base. A first side wall and a second side wall extend upward from the base. The first side wall includes a first height from the base being greater than a second height of the second side wall from the base by approximately 1 cm (0.39 inches).

In a further embodiment of any of the above, the base of the sink includes a width of approximately 118 cm (46.46 inches).

In a further embodiment of any of the above, the base includes a plurality of flow directing features that extend from a corresponding corner region of the base to the drain with the flow directing features being nonplanar with adjacent base segments.

In a further embodiment of any of the above, the plurality of flow directing feature are triangular and increase in width towards the drain with a distal end of each of the flow directing features intersecting the drain. A projection of each of the flow directing features over the drain overlaps a center of the drain.

In a further embodiment of any of the above, a sum of a width of each of the distal ends of the flow directing features at the intersection with the drain is between 50% and 60% of a circumference of the drain.

In a further embodiment of any of the above, a distance between adjacent flow directing features of the plurality of flow directing features extending from a corresponding one of the first side wall or the second side wall is less than 1.5 cm (0.59 inches).

In a further embodiment of any of the above, a distance between adjacent flow directing features of the plurality of flow directing features extending from a corresponding one of the first side wall or the second side wall is approximately 1.0 cm (0.39 inches).

In a further embodiment of any of the above, the center of the drain is located between 15% and 25% of a width of the base from one of the first side wall or the second side wall.

In a further embodiment of any of the above, an intersection between the first and second side walls and a corresponding one of the front and rear walls is welded from an exterior side of the sink.

In a further embodiment of any of the above, the front wall and the rear wall each include a first accessory rail a first distance from the base and an upper perimeter of the front and rear walls. The first and second side walls include a mounting ledge for engaging a mounting structure having a plurality of threaded sink supports.

In a further embodiment of any of the above, an interior surface of each of the front wall, the rear wall, the first side wall, and the second side wall includes a non-directional abraded finish.

In a further embodiment of any of the above, a ratio of a difference in height between the first side wall and the second side wall to a width of the base is approximately 0.00556.

In another exemplary embodiment, a sink assembly includes a sink including a base with a front wall, a rear wall, a first side wall, and a second side wall that extends upward from the base forming a basin. A mounting ledge extends along up upper edge of at least a portion of the front wall, the rear wall, and the pair of side walls. A mounting structure defines a central opening for accepting the sink. There is a plurality of sink supports for engaging the mounting structure and the sink.

In a further embodiment of any of the above, the plurality of sink supports include a first plurality of sink supports engaging the mounting ledge.

In a further embodiment of any of the above, a second plurality of sink supports of the plurality of sink supports engages at least one of the front wall, the rear wall, the first side wall, or the second side wall is spaced from an interior surface of the mounting structure.

In a further embodiment of any of the above, wherein the plurality of sink supports includes a threaded body with a head having a sink engagement surface. The threaded body rotatably engages a threaded attachment on the mounting structure.

In another exemplary embodiment, a method of forming a sink includes obtaining a single piece of material to form a sink base, a front wall, a rear wall, a first side wall and a second side wall. A plurality of flow directing features is formed in the sink base that extend from a corresponding corner of the base to a drain in the base. The plurality of flow directing features are triangular and increase in width towards the drain. A distal end of each of the flow directing features intersect the drain and a sum of a width of each of the distal ends of the flow directing features at the intersection with the drain is between 50% and 60% of a circumference of the drain. A ledge is formed in the front wall and the rear wall spaced from inward from an outer edge of each of the front wall and the rear wall.

In a further embodiment of any of the above, the flow directing features are nonplanar with adjacent base sections. A projection of each of the flow directing features overlaps a center of the drain.

In a further embodiment of any of the above, an exterior side of corners formed at intersections of the front and rear walls is welded with a corresponding one of the first and second side walls.

In a further embodiment of any of the above, a non-directional abraded finish is formed on the base, the front wall, the rear wall, the first side wall, the second side wall, and the ledge.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
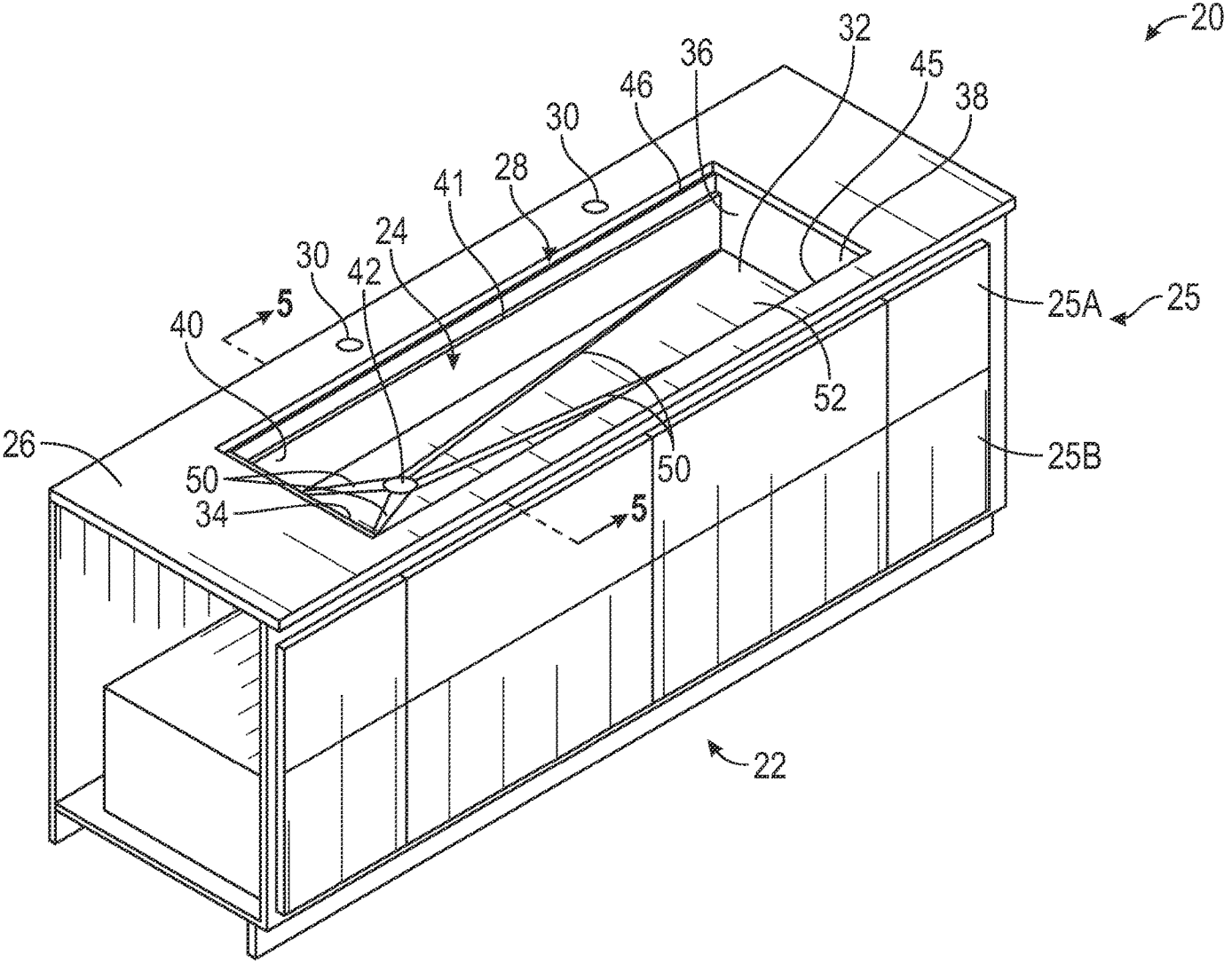
FIG. 1 illustrates an example cabinet assembly having a sink.

FIG. 1 illustrates an example sink cabinet assembly 20 including a base cabinet 22 and a sink 24. The base cabinet 22 can include multiple forms and in the illustrated example includes multiple drawers 25 with an upper set of drawers 25A including false fronts and a lower set of drawer 25B attached to drawer boxes that slide in and out of the base cabinet 22. A countertop 26 is located at upper edges of the base cabinet 22 and can be used for food preparation adjacent the sink 24. The countertop 26 includes a sink opening 28 for providing access to the sink 24 from the countertop 26 with the sink abutting a lower surface of the countertop 26 to provide a water tight fit with the countertop 26. At least one faucet opening 30 extends through the countertop 26 for attaching a faucet to the countertop 26 and allowing the faucet to access associate plumbing in the base cabinet 22 to provide water into the sink 24 or for filling pots and pans with water.

As shown in FIGS. 1-5, the sink 24 includes a base 32, a first side wall 34, a second side wall 36, a front wall 38, and a rear wall 40 that form a water tight basin. The front wall 38 and the rear wall 40 each include a lower accessory rail 39, 41, respectively. The lower accessory rails 39, 41 are defined by a ledge surface in each of the front and rear walls 38, 40, respectively, for supporting an accessory 43 (FIG. 5), such as a cutting board. The lower accessory rails 39, 41 terminate at the first and second side walls 34, 36.

In the illustrated example, the sink 24 extends approximately 113.9 cm (44.84 inches) in width between the first and second side walls 34, 36 and the first side wall 34 includes a height H1 of 25.5 cm (10.0 inches) and the second side wall 36 having a height H2 of 24.5 cm (9.65 inches). Therefore, a difference in height between the first side wall 34 and the second side wall 36 is approximately 1 cm (0.39 inches) with a ratio of a difference in height between the side walls 34, 36 and the width of the base 32 being approximately 0.00556. In this disclosure, approximately includes a 15% range surrounding the value. One feature of having side walls and/or a base with this configuration is a reduction in water splashing as it moves along the base 32 towards the drain 42.

Figure 5:
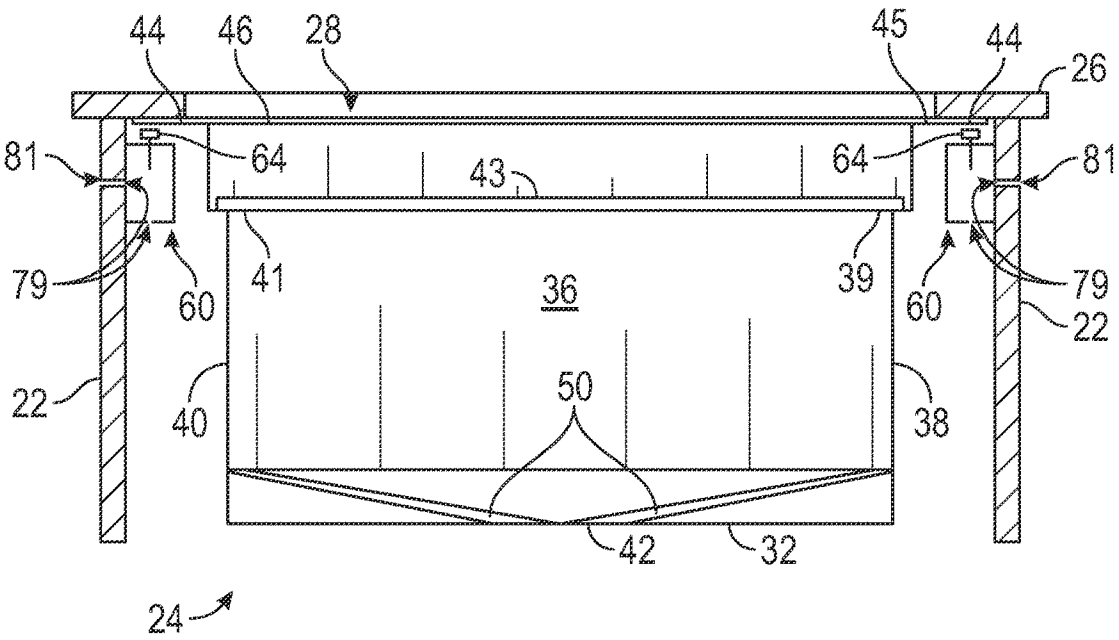
FIG. 5 illustrates a cross-sectional view taken along line 5-5 of FIG. 1.

The sink 24 also includes an upper ledge 44 that surrounds an upper edge of the sink 24 along the first and second side walls 34, 36 and the front and rear walls 38, 40. The upper ledge 44 is deeper along the front and rear walls 38, 40 to allow a portion along the upper ledge 44 to be sealed to the countertop 26. A portion of the upper ledge 44 adjacent an edge with the front wall 34 defines an upper accessory rail 45 and a portion of the upper ledge 44 along the rear wall 40 defines another upper accessory rail 46. Each of the upper accessory rails 45, 46 are configured for accepting one of the accessory 43 (FIG. 5). The same accessory 43 can be used on both the lower accessory rails 39, 41 or the upper accessory rails 45, 46 by rotating the accessory 43 by 90 degrees to achieve a desired width between the rails 39, 41, 45, and 46.

The base 32 of the sink 24 includes flow directing features 50 that aid in directing the flow of water in the sink 24 towards the drain 42. The flow directing features 50 extend from intersections of the first and second side walls 34, 36 with corresponding front and rear falls 38, 40. In the illustrated example, the flow directing features 50 are triangular and expand at a constant rate from a corner region of the base 32 towards the drain 42. The flow directing features 50 are located in a plane separate from adjacent sections 52 of the base 32. The flow directing features 50 and the segments 52 may also include non-flat arched portions to accommodate the change in depth of the base 32. In the illustrated example, there are four flow directing features 50 and four segments 52 separating the flow directing features 50.

Figure 2:
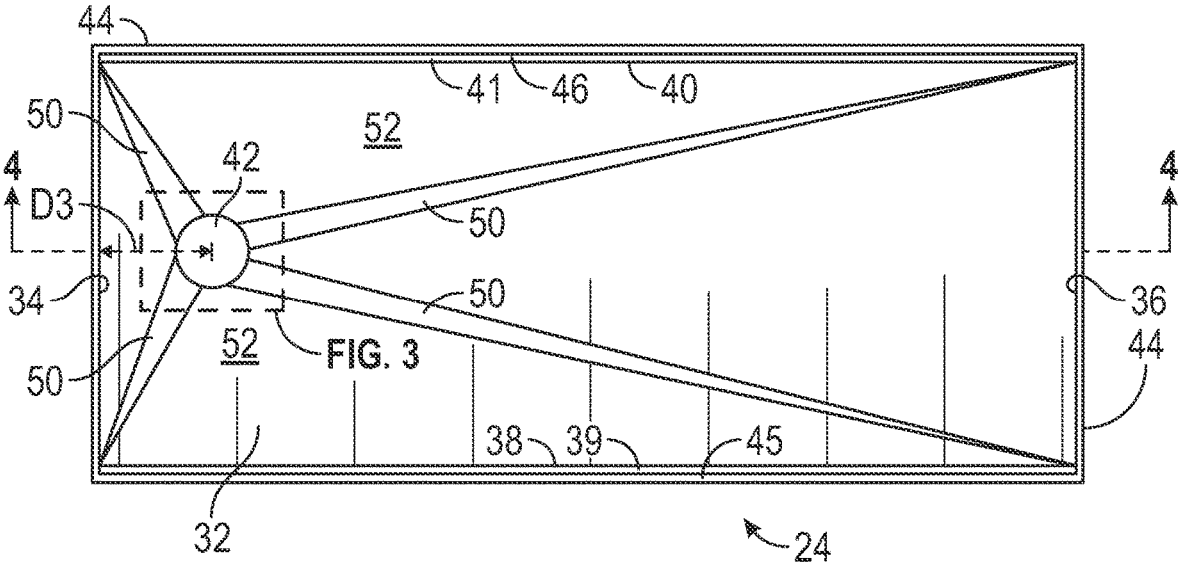
FIG. 2 illustrates a top view of the sink of FIG. 1.
Figure 3:
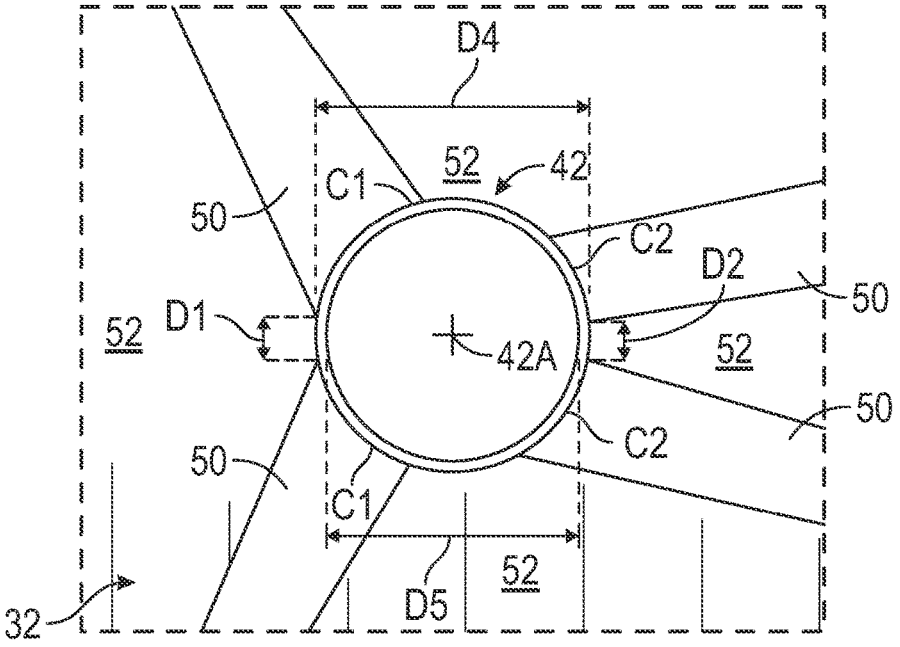
FIG. 3 illustrates an enlarged view of a drain of the sink of FIG. 1.
Figure 4:
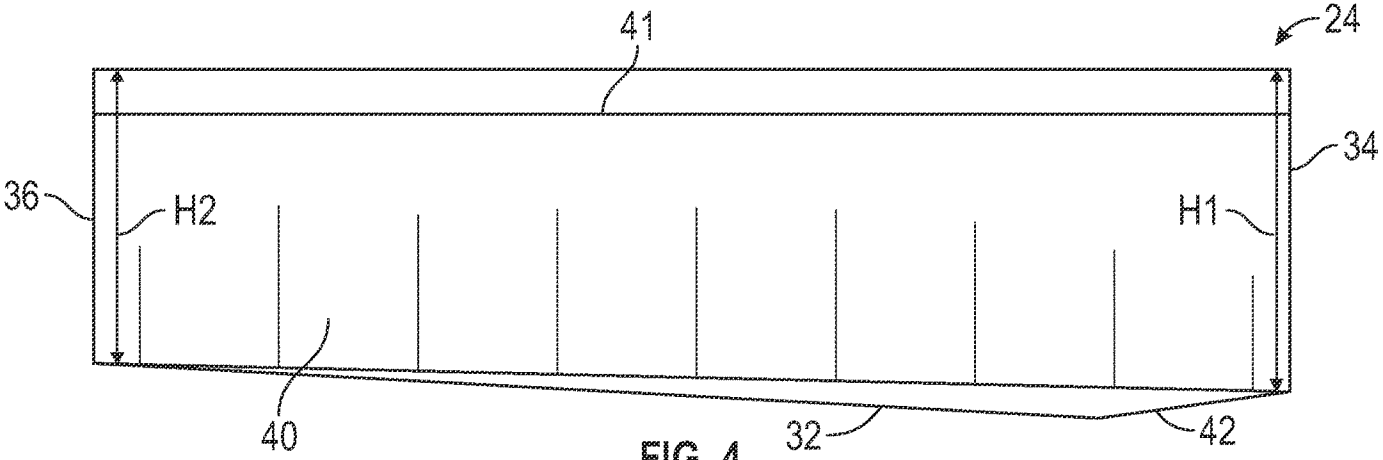
FIG. 4 illustrates a cross-sectional view taken along line 4-4 of FIG. 2.

As shown FIGS. 2-3, distal ends of the flow directing features 50 intersect a circular portion of the drain 42. Additionally, if the lateral edges defining the flow directing features 50 were projected over the drain 42, the projection of the flow directing features 50 would overlap a center 42A of the drain 42. The center 42A of the drain 42 is located between 15% and 25% of a width of the base 32 from one of the first side wall 34 or the second side wall 38. In the illustrated example, the center 42A is located a distance D3 of 20.85 cm (8.209 inches) from the first wall 34. The drain 42 can also include a bent flange 47 (FIG. 3) with a drain hole having a diameter D5 of approximately 8.27 cm (3.43 inches) and the flange 47 having an outer diameter D4 of approximately 12.5 cm (4.92 inches) One feature of having the flow directing features 50 overlap the center of the drain 42A is improved flow of water into the drain 42 while the water travels along the base 32 from the first and second side walls 34, 36.

Additionally, a first pair of flow directing features 50 extending from corners of the base 32 adjacent the first side wall 34 are spaced by a distance D1 at an intersection with the drain 42. Similarly, a second pair of the flow directing features 50 extending from corners of the base 32 adjacent the second side wall 36 are spaced by a distance D2 at an intersection with the drain 42. In the illustrated example, the distances D1 and D2 are both approximately 1 cm (0.39 inches) or less than 1.5 cm (0.59 inches). Additionally, a sum of a width of each of the distal ends of the flow directing features 50 at the intersection with the drain 42 is between 50% and 60% of a circumference of the drain 42. A first pair of flow directing features 50 extending from the first wall 34 intersects a circumferential segment C1 of the drain flange 47 of approximately 5.7 cm (2.24 inches) and a second pair of flow directing features 50 extending from the second wall 36 intersects a circumferential segment C2 of the drain flange 47 of approximately 5.1 cm (2.01 inches). One feature of this configuration is improved flow of water into the drain 42.

Figure 6:
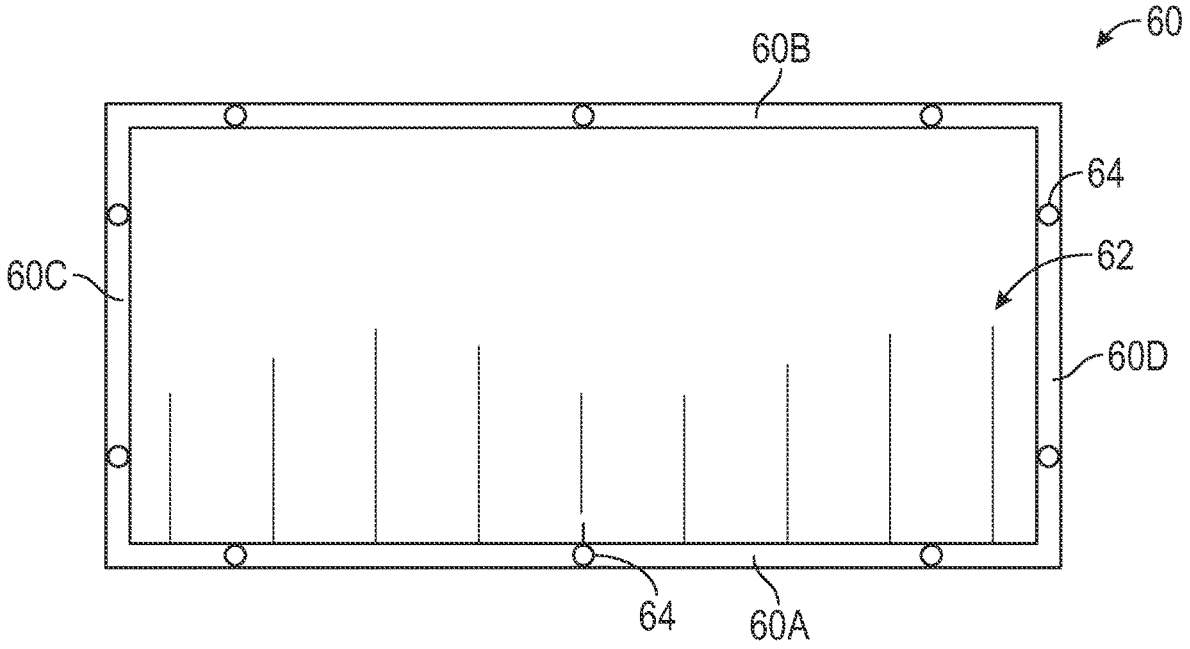
FIG. 6 illustrates an example mounting structure for the sink of FIG. 1.
Figure 7:
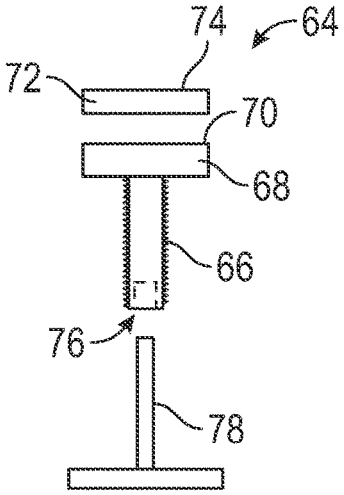
FIG. 7 illustrates an example sink support for the mounting structure of FIG. 6.

As shown in FIG. 5-7, a mounting structure 60 is used to mount the sink 24 relative to the base cabinet 22. In the illustrated example, the mounting structure 60 is formed from a hollow tube welded together at the corners. The hollow tubes include a front rail 60A, a rear rail 60B, a first side rail 60C, and a second side rail 60D that form an opening 62 shaped to receive the front wall 38, the rear wall 40, the first side wall 34, and the second side wall 36, respectively. The opening 62 is larger than an outer perimeter of the walls 34, 36, 38, and 40 to allow the sink 24 to fit within the mounting structure 60. While the sink supports 64 are shown along the rails 60A, 60B, 60C, and 60D, the sink supports 64 can be located along only opposing sides of the mounting structure 60 or along a single side of the mounting structure 60. Additionally, the mounting structure 60 could eliminate the sink supports 64 and directly engage the sink 24.

In the illustrated example, the sink supports 64 include a threaded body portion 66 fixed to a head 68 having a sink contact surface 70 for engaging the sink 24. A support disk 72, such as a rubber or felt disk, may be attached to the sink contact surface 70 on a first side and includes a sink contact surface 74 on a second opposite side of the support disk 72. One feature of the support disk 72 is to eliminate metal on metal contact between the sink supports 64 and the sink 24 to reduce wear at those points of contact.

The threaded body 66 includes a socket 76 having multiple faces at a proximal end opposite the head 68 for accepting a driver 78. The driver 78 can access the socket 76 in the sink support 64 through openings 79 in the mounting structure 60 for adjusting contact with the upper ledge 44. The base cabinet 22 can include openings 81 to fasten the mounting structure 60 to the base cabinet 22. The driver 78 is used to rotate the sink support 64 to provide further adjustments to the sink 24 during installation. In particular, the sink supports 64 can be adjusted in small increments to improved fitment of the upper ledge 44 against the countertop 26 and to distribute load from the sink 24 evenly along the mounting structure 60.

Figure 8:
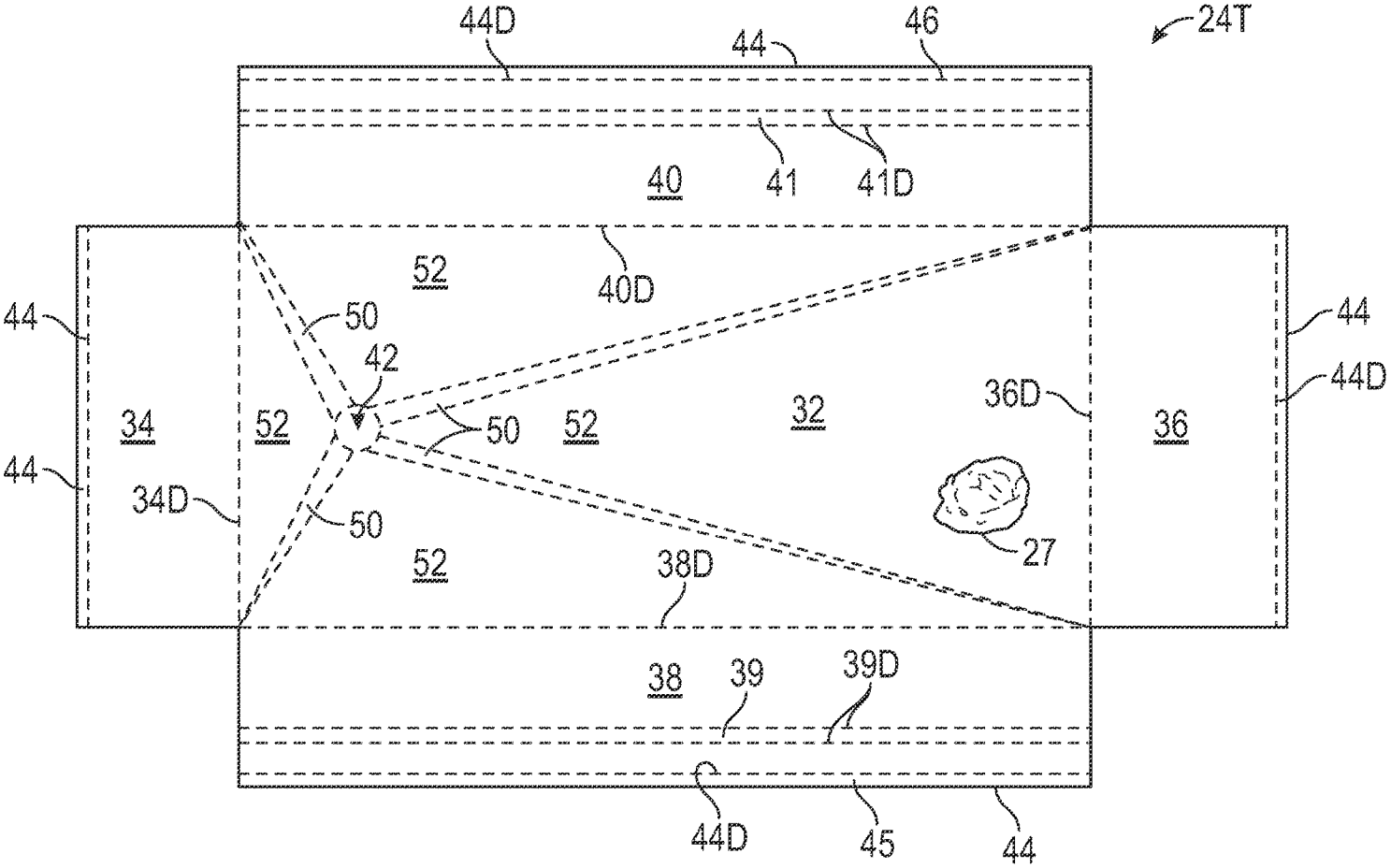
FIG. 8 illustrates an example metallic sink template for making the sink of FIG. 1.
Figure 10:
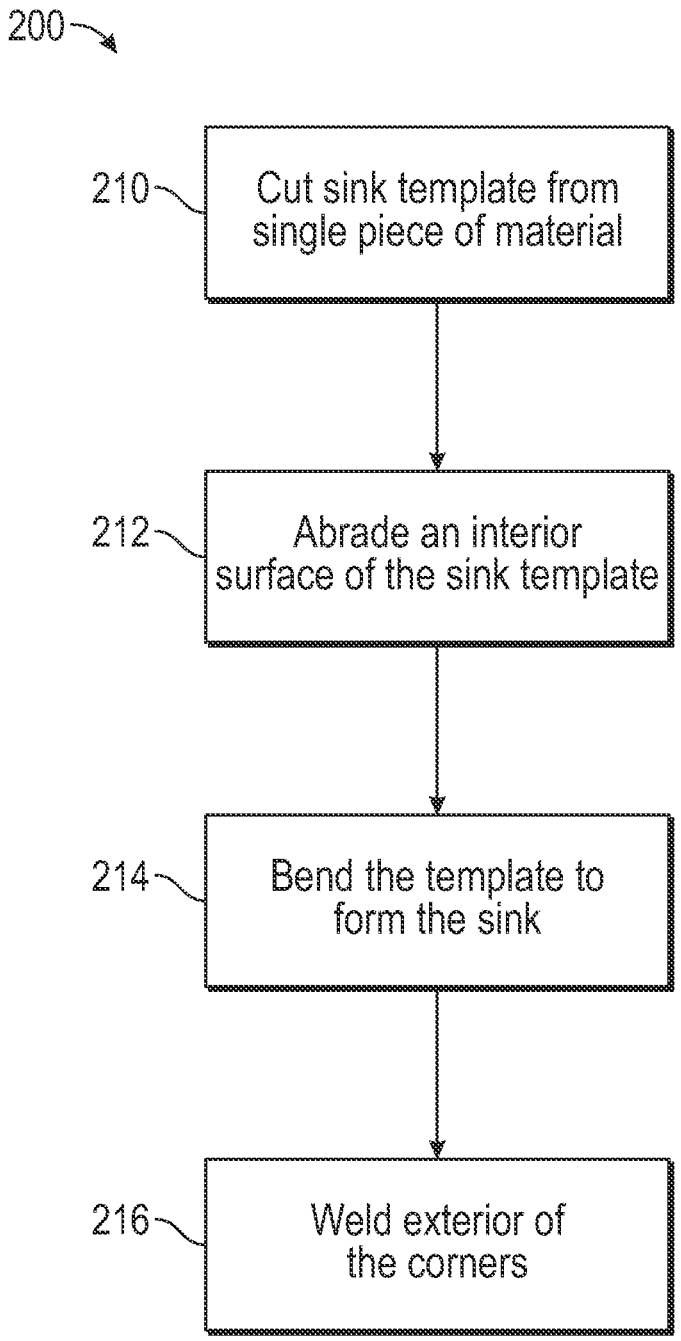
FIG. 10 illustrates an example method of forming the sink of FIG. 1 from the template of FIG. 8.

FIG. 10 illustrates an example method 200 of forming the sink 24. A sink template 24T (FIG. 8) for the sink 24 is formed (Step 210) from a single piece of material, such as stainless steel. In one example, the material used for the sink template 24T is V4A Quality Steel (V4A (material no. 1.4404=AISI 316L)) with a Chemical Consistency of 12% Ni, 17% Cr, 2.5% Mo, 2% Mn, 1% Si, 0.03% C max, and a remainder Fe. By forming the base 32 and walls 34, 36, 38, and 40 of the sink 24 from only a single piece of material, the number and length of welds needed to connect the walls is reduced. This improves the sharpness of the inside corners and reduces the exposure of weld lines to water which can age and collect debris at different rates than the base 32 and walls 34, 36, 38, and 40.

Additionally, the interior surface of the sink template 24T can be abraded to form a non-directional abraded surface 27 (FIG. 8) through the use of a circular sander (Step 212). One feature of the non-directional abraded surface 27 over a traditional abraded surface is an improvement in split resistance in all directions as opposed to a traditional brushed surface that is brushed in a single direction. This is particularly beneficial in reducing movement of the accessories 43 on the lower accessory rails 39, 41 or the upper accessory rails 45, 46.

The template 24T can then be bent to form the sink 24 (Step 214). In one example, the flow directing features 50 on the base 32 are formed prior to bending the walls 34, 36, 38, and 40. A die or press is used to form the flow directing features 50 along the dashed lines 50D that surround the flow directing features 50. The die creates different contours between the flow directing features 50 and the adjacent segments 52. The drain 42 in the base 32 is also formed through a drilling process and the flange 47 can be formed with a die or press.

The dashed lines 34D, 36D, 38D, and 40D between the base 32 and the walls 34, 36, 38, and 40, respectively, indicate bend locations of approximately 90 degrees. The bends along the dashed lines 34D, 36D, 38D, and 40D bring the first and second side walls 34, 36 into contact with corresponding edges of the front and rear walls 38, 40.

Figure 9:
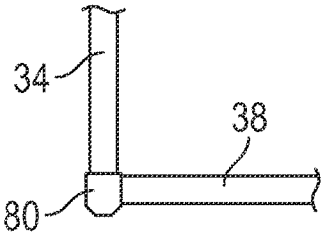
FIG. 9 illustrates an example weld line at a corner of the sink of FIG. 1.

To secure the edges of the first and second sides walls 34, 36 to corresponding edges of the front and rear walls 38, 40, the edges are welded from an exterior side of the sink as illustrated by the weld line 80 in FIG. 9 (Step 216). The weld line 80 forms a water tight seal between the edges while eliminating or reducing the amount of the weld line 80 that is visible from the inside of the sink 24. This reduces wear on the weld line 80 during use of the sink 24 which can occur at a different rate from the stainless steel of the remaining sink 24. Welding from the exterior of the sink 24 also increases a sharpness of the corner by reducing a radius or fillet that would be formed when welding from an interior of the sink 24.

The dashed lines 39-D and 44D indicate the bend locations on the front wall 38 to form the lower accessory rail 39 and the upper ledge 44/upper accessory rail 45. Similarly, the dashed lines 41D and 44D along the rear wall 40 indicate the bend locations on the rear wall 40 to form the lower accessory rail 41 and upper ledge 44/upper accessory rail 45. The dashed line 44D also indicate the bend locations the first and second side walls 34, 36 to form the upper ledge 44.

Although the different non-limiting examples are illustrated as having specific components, the examples of this disclosure are not limited to those particular combinations. It is possible to use some of the components or features from any of the non-limiting examples in combination with features or components from any of the other non-limiting examples.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A sink comprising:
a base having a drain;
a front wall extending upward from the base;
a rear wall extending upward from the base; and
a first side wall and a second side wall extending upward from the base, wherein the first side wall includes a first height from the base being greater than a second height of the second side wall from the base by approximately 1 cm (0.39 inches);
wherein the base includes a plurality of flow directing features extending from a corresponding corner region of the base to the drain with the flow directing features being nonplanar with adjacent base segments;
wherein the plurality of flow directing feature are triangular and increase in width towards the drain with a distal end of each of the flow directing features intersecting the drain and a projection of each of the flow directing features over the drain overlaps a center of the drain.

2. The sink of claim 1, wherein the base of the sink includes a width of approximately 118 cm (46.46 inches).

3. The sink of claim 1, wherein a sum of a width of each of the distal ends of the flow directing features at the intersection with the drain is between 50% and 60% of a circumference of the drain.

4. The sink of claim 1, wherein a distance between adjacent flow directing features of the plurality of flow directing features extending from a corresponding one of the first side wall or the second side wall is less than 1.5 cm (0.59 inches).

5. The sink of claim 1, wherein a distance between adjacent flow directing features of the plurality of flow directing features extending from a corresponding one of the first side wall or the second side wall is approximately 1.0 cm (0.39 inches).

6. The sink of claim 1, wherein the center of the drain is located between 15% and 25% of a width of the base from one of the first side wall or the second side wall.

7. The sink of claim 1, wherein an intersection between the first and second side walls and a corresponding one of the front and rear walls is welded from an exterior side of the sink.

8. A sink comprising:

a base having a drain;

a front wall extending upward from the base;

a rear wall extending upward from the base; and a first side wall and a second side wall extending upward from the base, wherein the first side wall includes a first height from the base being greater than a second height of the second side wall from the base by approximately 1 cm (0.39 inches);

wherein the front wall and the rear wall each include a first accessory rail a first distance from the base and an upper perimeter of the front and rear walls and the first and second side walls include a mounting ledge for engaging a mounting structure having a plurality of threaded sink supports.

9. The sink of claim 1, wherein an interior surface of each of the front wall, the rear wall, the first side wall, and the second side wall includes a non-directional abraded finish.

10. The sink of claim 1, wherein a ratio of a difference in height between the first side wall and the second side wall to a width of the base is approximately 0.00556.

11. The sink of claim 8, wherein the base of the sink includes a width of approximately 118 cm (46.46 inches).

12. The sink of claim 8, wherein the base includes a plurality of flow directing features extending from a corresponding corner region of the base to the drain with the flow directing features being nonplanar with adjacent base segments.

13. The sink of claim 12, wherein the plurality of flow directing feature are triangular and increase in width towards the drain with a distal end of each of the flow directing features intersecting the drain and a projection of each of the flow directing features over the drain overlaps a center of the drain.

14. The sink of claim 13, wherein a sum of a width of each of the distal ends of the flow directing features at the intersection with the drain is between 50% and 60% of a circumference of the drain.

15. The sink of claim 13, wherein a distance between adjacent flow directing features of the plurality of flow directing features extending from a corresponding one of the first side wall or the second side wall is less than 1.5 cm (0.59 inches).

16. The sink of claim 13, wherein a distance between adjacent flow directing features of the plurality of flow directing features extending from a corresponding one of the first side wall or the second side wall is approximately 1.0 cm (0.39 inches).

17. The sink of claim 13, wherein the center of the drain is located between 15% and 25% of a width of the base from one of the first side wall or the second side wall.

18. The sink of claim 8, wherein an intersection between the first and second side walls and a corresponding one of the front and rear walls is welded from an exterior side of the sink.

19. The sink of claim 8, wherein an interior surface of each of the front wall, the rear wall, the first side wall, and the second side wall includes a non-directional abraded finish.

20. The sink of claim 8, wherein a ratio of a difference in height between the first side wall and the second side wall to a width of the base is approximately 0.00556.

* * * * *